US011491752B2

(12) United States Patent
Termanas et al.

(10) Patent No.: US 11,491,752 B2
(45) Date of Patent: Nov. 8, 2022

(54) PRESS-TYPE STRAPPING MACHINE WITH IMPROVED TOP-PLATEN CONTROL

(71) Applicant: SIGNODE INDUSTRIAL GROUP LLC, Glenview, IL (US)

(72) Inventors: Jeffrey D. Termanas, Rolling Meadows, IL (US); Janusz Ciurkot, Palatine, IL (US); Thomas M. Mason, Island Lake, IL (US)

(73) Assignee: Signode Industrial Group LLC, Tampa, FL (US)

( * ) Notice: Subject to any disclaimer, the term of this patent is extended or adjusted under 35 U.S.C. 154(b) by 387 days.

(21) Appl. No.: 16/590,978

(22) Filed: Oct. 2, 2019

(65) Prior Publication Data

US 2020/0139657 A1 May 7, 2020

Related U.S. Application Data

(60) Provisional application No. 62/754,197, filed on Nov. 1, 2018.

(51) Int. Cl.
*B30B 9/30* (2006.01)
*B65B 13/20* (2006.01)

(52) U.S. Cl.
CPC ..... *B30B 9/3007* (2013.01); *B30B 9/305* (2013.01); *B65B 13/20* (2013.01)

(58) Field of Classification Search
CPC ..... B65B 13/20; B65B 13/18; B30B 9/3007; B30B 9/305; B30B 15/281
USPC ..... 100/3
See application file for complete search history.

(56) References Cited

U.S. PATENT DOCUMENTS

| | | | | |
|---|---|---|---|---|
| 4,018,146 | A * | 4/1977 | Evans | B65B 13/18 100/29 |
| 4,635,542 | A | 1/1987 | Sebelist et al. | |
| 4,938,009 | A | 7/1990 | Takami | |
| 5,353,315 | A | 10/1994 | Scarola et al. | |
| 6,546,696 | B2 | 4/2003 | Cranston, III et al. | |
| 7,281,403 | B2 * | 10/2007 | Sperrer | F16P 3/144 72/21.2 |
| 7,428,865 | B1 * | 9/2008 | Kasel | B65B 27/10 53/529 |
| 7,765,778 | B2 | 8/2010 | Schuttler et al. | |
| 7,798,060 | B2 | 9/2010 | Pearson et al. | |
| 8,689,684 | B2 | 4/2014 | Haberstroh et al. | |
| 9,145,283 | B2 | 9/2015 | Oehm et al. | |
| 9,238,516 | B2 | 1/2016 | Termanas | |
| 10,017,283 | B2 | 7/2018 | Kastner | |
| 2012/0299727 | A1 | 11/2012 | Newman et al. | |
| 2018/0229869 | A1 | 8/2018 | Schultz | |

(Continued)

FOREIGN PATENT DOCUMENTS

| | | | |
|---|---|---|---|
| EP | 0681958 | A1 | 11/1995 |
| EP | 0931449 | A1 | 7/1999 |
| EP | 2660158 | A1 | 11/2013 |

(Continued)

*Primary Examiner* — Jimmy T Nguyen
(74) *Attorney, Agent, or Firm* — Neal, Gerber & Eisenberg LLP

(57) ABSTRACT

Various embodiments of the present disclosure provide a press-type strapping machine configured to strap a load when both the height of the load falls within a target height range and the compressive force applied to the load falls within a target compressive force range.

19 Claims, 6 Drawing Sheets

(56) References Cited

U.S. PATENT DOCUMENTS

2018/0237177 A1 8/2018 Schultz et al.

FOREIGN PATENT DOCUMENTS

| | | | |
|---|---|---|---|
| EP | 2700577 | A1 | 2/2014 |
| EP | 2700578 | A1 | 2/2014 |
| EP | 2700579 | A1 | 2/2014 |
| EP | 2733077 | A1 | 5/2014 |
| EP | 2778075 | A1 | 9/2014 |
| EP | 2778076 | A1 | 9/2014 |

* cited by examiner $F_C < F_{LB} < F_{UB}$ $D_{LB} < D_{UB} < H_L < D$ $F_{LB} < F_{UB} < F_C$ $D_{LB} < D_{UB} < H_L$ , D $F_C < F_{LB} < F_{UB}$ $D_{LB} < H_L < D_{UB} < D$ $F_C < F_{LB} < F_{UB}$ $H_L$ , $D < D_{LB} < D_{UB}$

PRESS-TYPE STRAPPING MACHINE WITH IMPROVED TOP-PLATEN CONTROL

PRIORITY

This application claims priority to and the benefit of U.S. Provisional Patent Application No. 62/754,197, filed Nov. 1, 2018, the entire contents of which is incorporated hereinby reference.

FIELD

The present disclosure relates to strapping machines, and more particularly to press-type strapping machines configured to apply a compressive force to a load before strapping the load.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components.

To strap the load, the strapping head first feeds strap (leading strap end first) from a strap supply into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head then cuts the strap from the strap supply to form a trailing strap end and attaches the leading and trailing strap ends to one another, thereby forming a tensioned strap loop around the load.

Press-type strapping machines are configured to apply a compressive force to the load to compact the load before strapping (such as to compact a stack of collapsed corrugated boxes before strapping) and/or to reduce the likelihood that the load will shift during strapping (such as to stabilize a stack of lumber during strapping). A typical press-type strapping machine includes a top platen supported by the frame and vertically movable (under the control of the controller) relative to the support surface (and the load). Before strapping the load, the top platen moves downward toward the support surface and into contact with the load, compressing the load if the load is compressible (e.g., a stack of collapsed corrugated boxes). The controller periodically determines and monitors the compressive force the top platen applies to the load, and stops the top platen once the applied compressive force reaches a designated compressive force. At this point, the controller holds the top platen in place and controls the strapping head to strap the load as detailed above. The top platen then moves upward to disengage the load and enable the load to be moved out of the strapping machine. If the load is compressible, as the top platen moves upward and disengages the load, the load expands upward (attempting to revert to its original height) until stopped by the tensioned strap loop.

One issue with known press-type strapping machines is that inaccurate determination of the compressive force can result in strapped identical loads of different heights. This is problematic for several reasons. Strapped loads must be shorter than a certain height to fit in shipping containers, so strapped loads that are (inadvertently) too tall will not be able to fit and must be re-strapped. Additionally, storage areas (such as warehouses) are usually configured to store strapped loads of particular heights, so strapped loads that are (inadvertently) too tall will not be able to fit and must be re-strapped. Further, viewing strapped identical loads having different heights is not aesthetically pleasing to customers and may lead to a mistaken belief that the loads are not identical. This could cause customers to waste time and labor checking the loads to confirm that they are in fact identical and/or checking that the load-stacking processes upstream of the press-type strapping machine are being performed properly. Also, a load that is compressed more than desired before being strapped could be damaged by the strap once the compressive force is removed and the load expands. Specifically, an over-compressed load will attempt to expand more than anticipated, causing the strap to cut into the load.

SUMMARY

Various embodiments of the present disclosure provide a press-type strapping machine that solves the above problems by strapping a load when both the height of the load falls within a target height range and the compressive force applied to the load falls within a target compressive force range.

In various embodiments, the strapping machine of the present disclosure comprises a frame; a top platen supported by the frame; a load supporter below the top platen; a top-platen actuator operably connected to the top platen to move the top platen toward and away from the load supporter; a strapping head; and a controller configured to: control the top-platen actuator to move the top platen toward the load supporter and a load positioned on the load supporter; and responsive to determining that both: (1) a distance between the top platen and the load supporter is within a target distance range; and (2) a compressive force the top platen applies to the load is within a target compressive force range, control the strapping head to strap the load.

In various embodiments, a method of operating a strapping machine of the present disclosure comprises moving a top platen toward a load supporter on which a load is positioned; and responsive to determining that both: (1) a distance between the top platen and the load supporter is within a target distance range; and (2) a compressive force the top platen applies to the load is within a target compressive force range, strapping the load.

DETAILED DESCRIPTION

Figure 1:
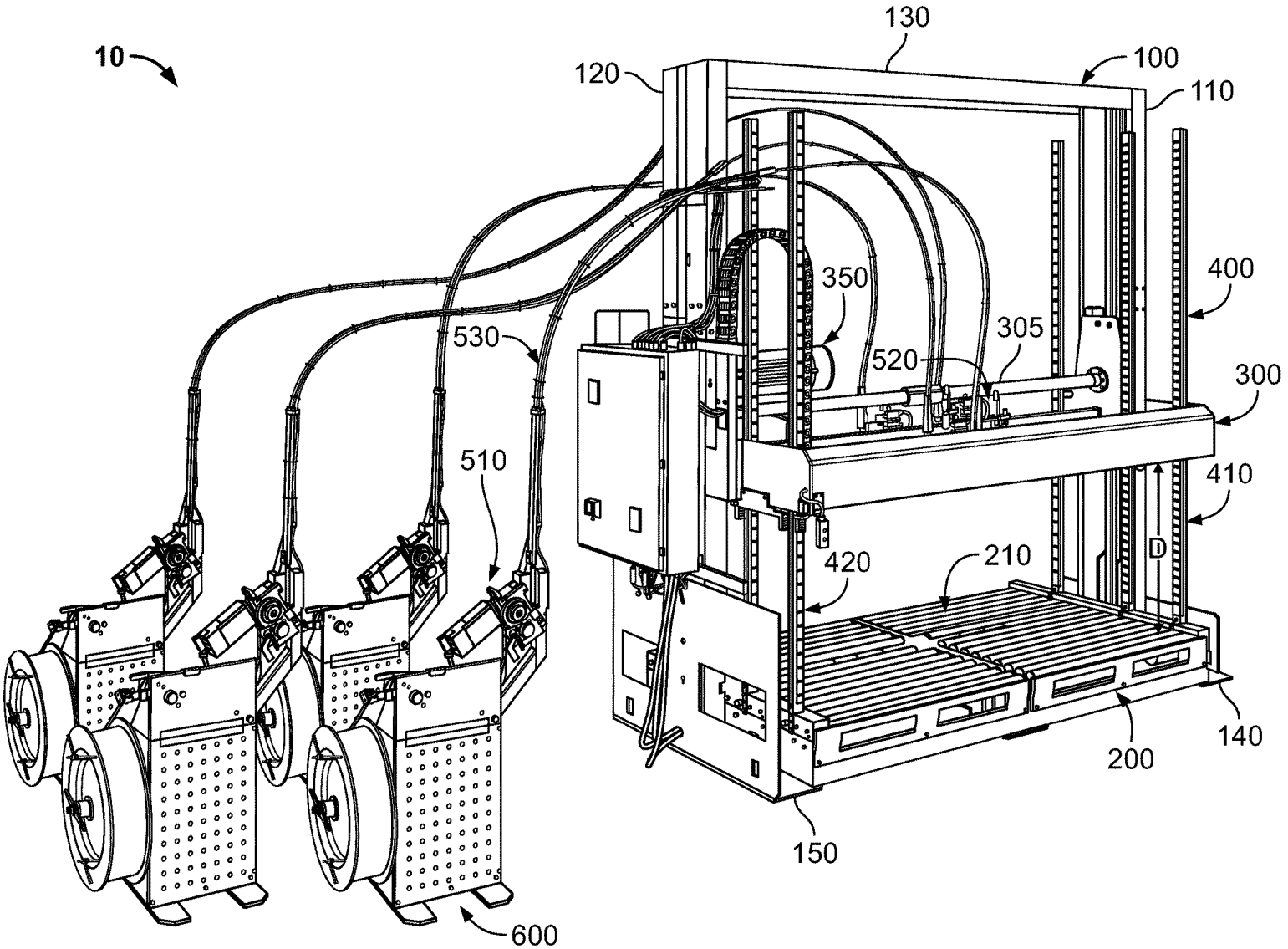
FIG. 1 is a perspective view of one example embodiment of a strapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 2:
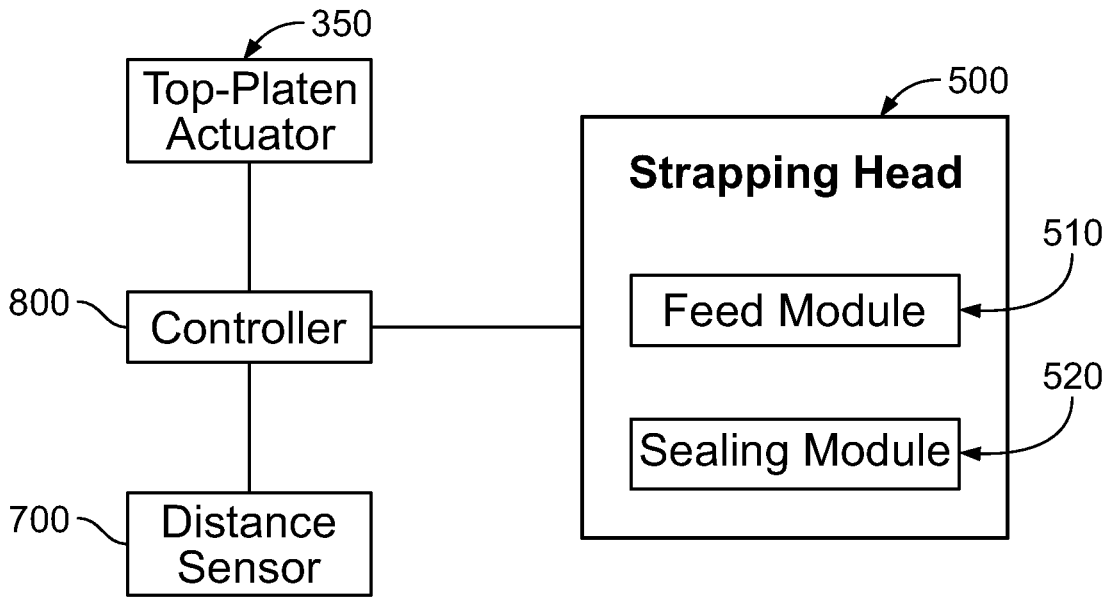
FIG. 2 is a block diagram showing certain components of the strapping machine of FIG. 1.

FIGS. 1 and 2 show one embodiment of the press-type strapping machine 10 of the present disclosure (referred to as the "strapping machine" below for brevity) and components thereof.

The strapping machine 10 includes a frame 100, a load supporter 200, a top platen 300, a top-platen actuator 350, multiple strap chutes 400 (only one of which is labeled for clarity), multiple strapping heads 500 (only one of which is labeled for clarity) each configured to draw strap from a respective strap supply 600 (only one of which is labeled for clarity), a distance sensor 700, and a controller 800.

The frame 100 is configured to support some (or all) of the other components of the strapping machine 10. In this example embodiment, the frame 100 includes first and second spaced-apart upstanding legs 110 and 120, a connector 130 that spans and connects the upper ends of the first and second legs 110 and 120, and first and second feet 140 and 150 connected to the lower ends of the first and second legs 110 and 120, respectively. Although not shown, the first and second legs 110 and 120 each include a vertically extending toothed rack to enable the top platen 300 to move relative to the first and second legs 110 and 120 in a rack-and-pinion fashion, as described below. This is merely one example of a configuration of components that form the frame 100, and any other suitable configuration of any other suitable components may form the frame 100 in other embodiments.

The load supporter 200 is positioned between the first and second legs 110 and 120 of the frame 100 and below the connector 130 of the frame 100. The load supporter 200 is configured to support loads as they are compressed and strapped by and as they move through the strapping machine 10. The load supporter 200 includes a support surface 210 on which the loads are positioned during compression and strapping and over which loads move as they move through the strapping machine 10. In this example embodiment, the support surface 210 includes multiple rollers that facilitate movement of the load through the strapping machine 10. The rollers may be driven or undriven. In other embodiments, the support surface includes a driven conveyor instead of rollers.

The top platen 300 is supported by the first and second legs 110 and 120 above the load supporter 200 and is vertically movable relative to the load supporter 200 so the top platen 300 can adjust to loads of different heights and apply a compressive force to the loads before and during strapping. In this example embodiment, the top platen 300 includes two rotatable pinions (not shown) fixed to a pinion shaft 305 such that the pinions and the pinion shaft 305 rotate together. The pinion shaft 305 spans the first and second legs 110 and 120 such that one pinion meshes with the toothed rack in the first leg 110 and the other pinion meshes with the toothed rack in the second leg 120. In this configuration, rotation of the pinions (which rotate together via their fixed connection to the pinion shaft 305) under control of the top-platen actuator 350 (described below) causes the pinions to climb or descend their respective toothed racks such that the top platen 300 moves away from or toward the support surface 210 of the load supporter 200 (i.e., upward or downward, as described in more detail below). The top platen 300 also includes one or more compression surfaces 310 (not shown, but numbered for ease of reference) on its underside for contacting and applying the compressive force to the load.

The top-platen actuator 350 is any suitable actuator, such as an electric motor, operably connected to the top platen 300 to move the top platen 300 relative to the first and second legs 110 and 120 toward and away from the support surface 210 of the load supporter 200 (i.e., downward and upward). In this example embodiment, the top-platen actuator 350 is operably connected to the pinions and the pinion shaft 305 of the top platen 300 via gearing (not shown) such that rotation of an output shaft (not shown) of the top-platen actuator 350 results in rotation of the pinions (and the pinion shaft 305) and vertical movement of the top platen 300. In one example embodiment, an output gear (not shown) of the gearing is meshed with one of the pinions such that rotation of the output gear (caused by rotation of the output shaft of the top-platen actuator 350) directly causes that pinion to rotate, which in turn causes the pinion shaft 305 and the other pinion to rotate. Rotating the output shaft of the top-platen actuator 350 in one direction results in movement of the top platen 300 away from the support surface 210, and rotation of the output shaft in the opposite direction results in movement of the top platen 300 toward the support surface 210. This is merely one example embodiment of the top-platen actuator, and any suitable actuator may be employed (such as a hydraulic or pneumatic actuator). Additionally, any other suitable manner of controlling vertical movement of the top platen 300 may be employed (e.g., hydraulic or pneumatic cylinders, belt-and-pulley assemblies, and the like), as the rack-and-pinion configuration is merely one example embodiment.

The strap chute 400 circumscribes the support surface 210 and defines a strap path that the strap follows when fed through the strap chute 400 and from which the strap is removed when retracted. The strap chute 400 includes two spaced-apart first and second upstanding legs 410 and 420, an upper connecting portion (not shown) that spans the first and second legs 410 and 420 and is positioned in the top platen 300, a lower connecting portion (not shown) that spans the first and second legs 410 and 420 and is positioned in the load supporter 200, and elbows that connect these portions. As is known in the art, the radially inward wall of the strap chute 400 is formed from multiple overlapping gates that are spring-biased to a closed position that enables the strap to traverse the strap path when fed through the strap chute 400. When the strapping head 500 later exerts a pulling force on the strap to retract the strap, the pulling force overcomes the biasing force of the springs and causes the gates to pivot to an open position, thereby releasing the strap from the strap chute so the strap contacts the load as the strapping head 500 continues to retract the strap. One example of this strap chute 400 is described in U.S. Pat. No. 7,428,865, the contents of which are incorporated herein by reference, though the strapping machine 10 may include any other suitable strap chute.

The strapping head 500 is configured to form a tensioned strap loop around the load by feeding the strap through the strap chute 400 along the strap path, holding the leading strap end while retracting the strap to remove it from the strap chute 400 so it contacts the load, tensioning the strap around the load to a designated tension, cutting the strap from the strap supply to form a trailing strap end, and connecting the leading strap end and trailing strap end to one another. In this example embodiment, the strapping head 500 is a modular strapping head including independently removable and replaceable feed and sealing modules 510 and 520. The feed module 510, which is configured to feed, retract, and tension the strap, is mounted to a frame (not labeled) of the strap supply 600. That is, in this example embodiment, the feed module 510 is located remote from the strapping machine 10 (though in other embodiments the feed module 510 may be supported by the frame 100 or any other suitable component of the strapping machine 10). The top platen 300 supports the sealing module 520, which is configured to hold the leading strap end, cut the strap from the strap supply, and connect the leading strap end and trailing strap end to one another. A strap guide 530 extends between the feed and sealing modules 510 and 520 and is configured to guide the strap as it moves between the modules.

Modular strapping heads of this type are known in the art. One example is described in U.S. Pat. No. 7,377,213, the contents of which are incorporated herein by reference, though the strapping machine 10 may include any suitable modular strapping head. In other embodiments, the strapping head 500 is any suitable non-modular strapping head (i.e., a strapping head that is not comprised of independently removable and replaceable feed and sealing modules). The manner of attaching the leading and trailing strap ends to one another depends on the type of strapping machine and the type of strap. Certain strapping machines configured for plastic strap include strapping heads with friction welders, heated blades, or ultrasonic welders configured to attach the leading and trailing strap ends to one another. Some strapping machines configured for plastic strap or metal strap include strapping heads with jaws that mechanically deform (referred to as "crimping" in the industry) or cut notches into (referred to as "notching" in the industry) a seal element positioned around the leading and trailing strap ends to attach them to one another. Other strapping machines configured for metal strap include strapping heads with punches and dies configured to form a set of mechanically interlocking cuts in the leading and trailing strap ends to attach them to one another (referred to in the strapping industry as a "sealless" attachment). Still other strapping machines configured for metal strap include strapping heads with spot, inert-gas, or other welders configured to weld the leading and trailing strap ends to one another.

The distance sensor 700 includes one or more suitable sensors configured to measure the vertical distance D (labeled in FIG. 1) between the support surface 210 of the load supporter 200 and the compression plates 310 of the top platen 300. The distance sensor may be, for instance, a laser sensor or an encoder.

The controller 800 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10 (such as to carry out the load verification and strapping process, as described below).

The controller 800 is communicatively and operably connected to the top-platen actuator 350 and the strapping head 500 to receive signals from and to control those components. The controller 800 is communicatively connected to the distance sensor 700 to receive signals from the distance sensor 700. As described below, the controller 800 is configured to control the top-platen actuator 350 and the strapping head 500 responsive to signals received from the top-platen actuator 350 and the distance sensor 700.

In this example embodiment, the controller 800 is configured to determine the compressive force $F_C$ the top platen 300 applies to the load based on feedback received from the top-platen actuator 350. Specifically, and as is known in the art, the controller 800 determines the applied compressive force $F_C$ based on the current drawn by the top-platen actuator 350. In other words, the controller 800 is configured to measure the current drawn by the top-platen actuator 350 and convert that measurement into the compressive force $F_C$ the top platen 300 applies to the load.

In this example embodiment, the controller 800 is also configured to determine the distance D between the support surface 210 and the compression plates 310 based on feedback received from the distance sensor 700. Here, since the distance sensor 700 directly measures the distance D, the controller 800 determines the distance D based on this direct measurement received from the distance sensor 700. In other embodiments, as described below, the controller 800 is configured to determine the distance D in other ways based on feedback from the distance sensor 700.

Operation of the strapping machine 10 to conduct a load verification and strapping process 1000 (sometimes referred to below as the "process 1000" for brevity) for a load positioned on the support surface 210 of the load supporter 200 and beneath the top platen 300 is now described in conjunction with the flowchart shown in FIG. 3. In this example embodiment, the strapping machine 10 is configured to strap the load when both of these conditions are met: (1) the distance D between the support surface 210 and the compression plates 310 is at least equal to a lower distance bound $D_{LB}$ and no greater than an upper distance bound $D_{UB}$ of a target distance range (i.e., $D_{LB} \leq D \leq D_{UB}$); and (2) the compressive force $F_C$ the top platen 300 applies to the load (calculated as described above) is at least equal to a lower compressive force bound $F_{LB}$ and no greater than an upper compressive force bound $F_{UB}$ of a target compressive force range (i.e., $F_{LB} \leq F_C \leq F_{UB}$).

The operator can set the upper and lower bounds of these ranges in accordance with the load to-be-strapped and the desired strapping characteristics via an input device (not shown) of the strapping machine 10 or a user device (such as a mobile phone or other computing device) that is communicatively connected to the controller 800. In other words, these ranges are preset by the operator (or the manufacturer).

The strapping machine 10 is configured not to strap the load if either: (1) the distance D between the support surface 210 and the compression plates 310 falls below the lower distance bound $D_{LB}$ of the target distance range before the compressive force $F_C$ the top platen 300 applies to the load reaches the lower compressive force bound $F_{LB}$ of the target compressive force range (which indicates the load is shorter than desired); or (2) the compressive force $F_C$ the top platen 300 applies to the load exceeds the upper compressive force bound $F_{UB}$ of the target compressive force range before the distance D between the support surface 210 and the compression plates 310 reaches the upper distance bound $D_{UB}$ of the target distance range (which indicates the load is taller than desired).

Figure 3:
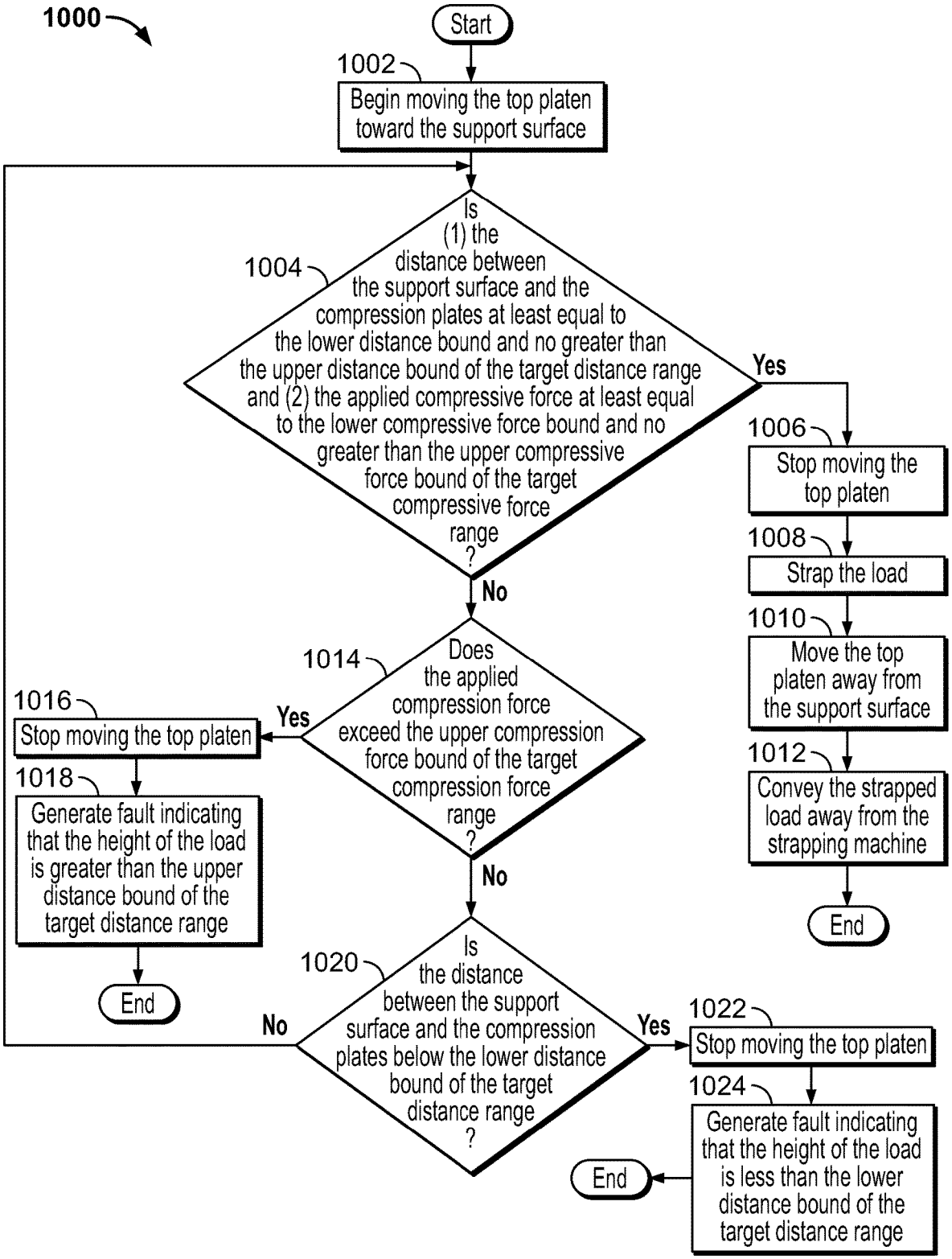
FIG. 3 is a flowchart showing a method of operating the strapping machine of FIG. 1 to carry out a load verification and strapping process.

Referring now to FIG. 3, upon starting the process 1000, the controller 800 controls the top-platen actuator 350 to begin moving the top platen 300 toward the support surface 210 and the load thereon, as block 1002 indicates. As this occurs, the controller 800 periodically determines and monitors: (1) the distance D between the support surface 210 and the compression plates 310 (which equals the height of the load once the compression plates 310 contact the load) based on feedback from the distance sensor 700; and (2) the compressive force $F_C$ the top platen 300 applies to the load.

As the controller 800 monitors the distance D and the applied compressive force $F_C$, the controller 800 determines whether both: (1) the distance D is at least equal to the lower distance bound $D_{LB}$ and no greater than the upper distance bound $D_{UB}$ of the target distance range (i.e., whether $D_{LB} \leq D \leq D_{UB}$); and (2) the applied compressive force $F_C$ is at least equal to the lower compressive force bound $F_{LB}$ and no greater than the upper compressive force bound $F_{UB}$ of the target compressive force range (i.e., whether $F_{LB} \leq F_C \leq F_{UB}$), as diamond 1004 indicates.

If the controller 800 determines that both of these conditions are satisfied, the controller 800 controls the top-platen actuator 350 to stop moving the top platen 300 downwardly (toward the support surface 210), as block 1006 indicates. The controller 800 then controls the strapping head 500 to strap the load, as block 1008 indicates. For instance, the controller controls the feed module 510 to feed the strap through the strap chute 400 along the strap path, controls the sealing module 520 to hold the leading strap end, controls the feed module 510 to retract the strap to remove it from the strap chute 400 so it contacts the load, controls the feed module 510 to tension the strap around the load to a designated tension, controls the sealing module 520 to cut the strap from the strap supply to form a trailing strap end, and controls the sealing module 520 to connect the leading strap end and trailing strap end to one another. This is described in more detail in U.S. Pat. No. 7,377,213, though any suitable strapping process may be employed, and may vary based on the type of strapping head and the type of strap. The controller 800 then controls the top-platen actuator 350 to move the top platen 300 upwardly (away from the support surface 210), as block 1010 indicates. The load can then be conveyed away from the strapping machine 10, as block 1012 indicates, and the process 1000 ends.

But if the controller 800 determines at diamond 1004 that both conditions are not met, the controller 800 determines whether the applied compressive force $F_C$ exceeds the upper compressive force bound $F_{UB}$ of the target compression force range, as diamond 1014 indicates. If so, the controller 800 controls the top-platen actuator 350 to stop moving the top platen 300 downwardly (toward the support surface 210), as block 1016 indicates. The controller 800 then generates a fault indicating that the height of the load which is equal to the distance D between the support surface 210 and the compression plates 310 in this scenario—is greater than the upper distance bound $D_{UB}$ of the target distance range, as block 1018 indicates, and the process 1000 ends. The controller 800 may control an output device (not shown) of the strapping machine 10 to indicate this fault. For instance, the controller 800 may control a display device to display indicia indicating the fault, a speaker to output a sound indicating the fault, or lights to light up to indicate the fault. In another example, the controller 800 may cause an electronic message indicating the fault to be sent, such as an email to an email address of the operator or a text message to a mobile device of the operator.

But if the controller 800 determines at diamond 1014 that the applied compressive force $F_C$ does not exceed the upper compressive force bound $F_{UB}$ of the target compression force range, the controller 800 determines whether the distance D between the support surface 210 and the compression plates 310 is below the lower distance bound $D_{LB}$ of the target distance range, as diamond 1020 indicates. If so, the controller 800 controls the top-platen actuator 350 to stop moving the top platen 300 downwardly (toward the support surface 210), as block 1022 indicates. The controller 800 then generates a fault indicating that the height of the load—which is equal to the distance D between the support surface 210 and the compression plates 310 in this scenario—is less than the lower distance bound $D_{LB}$ of the target distance range, as block 1024 indicates, and the process 1000 ends. The controller 800 may control an output device (not shown) of the strapping machine 10 to indicate this fault, such as in any of the manners described above.

But if the controller 800 determines at diamond 1020 that the distance D between the support surface 210 and the compression plates 310 remains greater than the lower distance bound $D_{LB}$ of the target distance range, the process 1000 returns to diamond 1004.

Figures 4A, 4B, 4C, 4D:
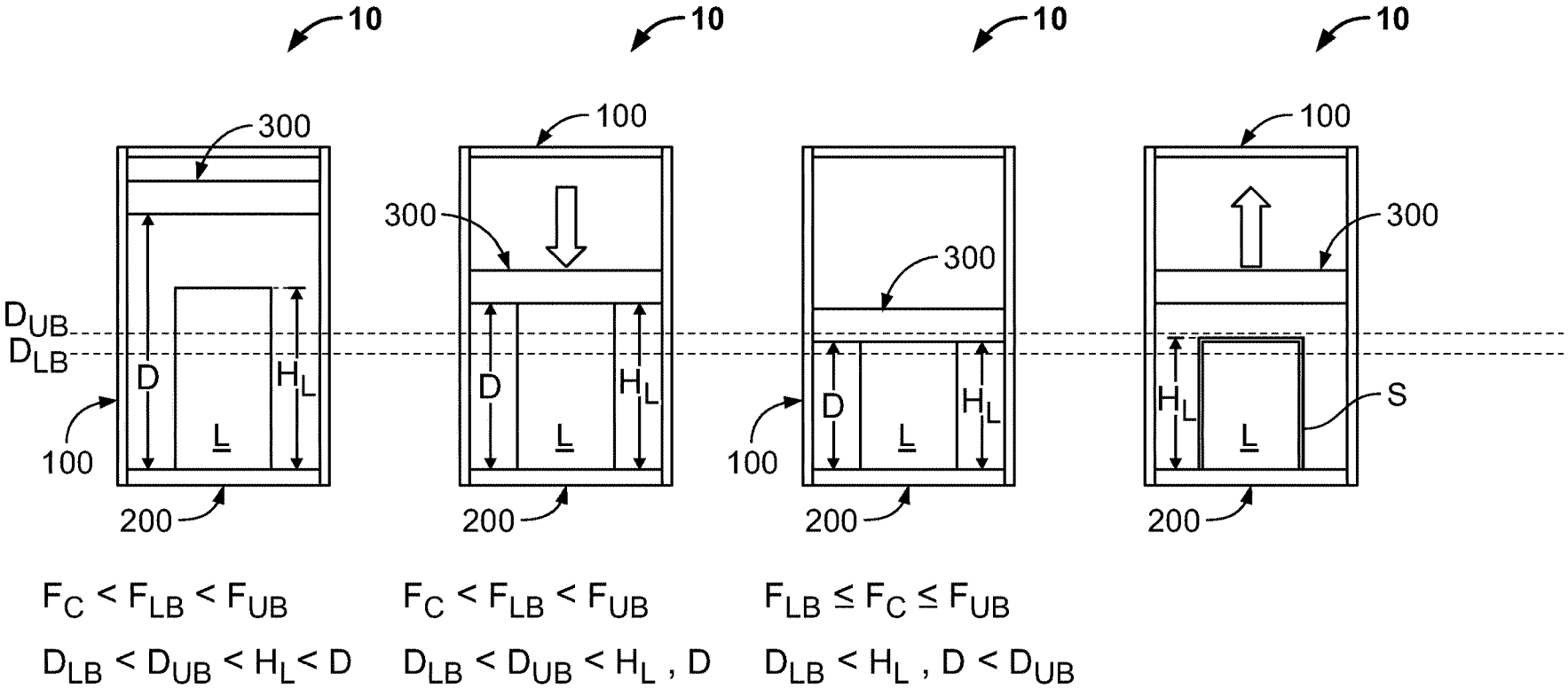
FIGS. 4A-4D are simplified front elevational views of the strapping machine of FIG. 1 during one example of the load verification and strapping process of FIG. 3.

FIGS. 4A-4D, 5A-5C, and 6A-6C generically illustrate the three different outcomes of the process 1000. Turning first to FIGS. 4A-4D, FIG. 4A illustrates the strapping machine 10 at the beginning of the process with a load L atop the load supporter 200 and beneath the top platen 300. The load L has a height $H_L$, which at this point is less than the distance D between the support surface 210 of the load supporter 200 and the compression plates 310 of the top platen 300 since the compression plates 310 are not contacting the load L. FIG. 4B illustrates the strapping machine 10 after the top platen 300 has moved downward and begun applying a compressive force $F_C$ to the load L. At this point, the controller 800 monitors the applied compressive force $F_C$ and the distance D, which at this point is equal to the height $H_L$ of the load L, as described above. FIG. 4C illustrates the strapping machine 10 after the controller 800 has determined that the distance D (and height $H_L$ of the load L) is within the target distance range, has determined that the applied compressive force $F_C$ is within the target compressive force range, and in response has stopped the downward movement of the top platen 300. FIG. 4D illustrates the strapping machine 10 after the controller 800 has controlled the strapping head 500 to strap the load L with strap S and has begun moving the top platen 300 upward to enable the strapped load L to be removed from the strapping machine 10.

Figures 5A, 5B, 5C:
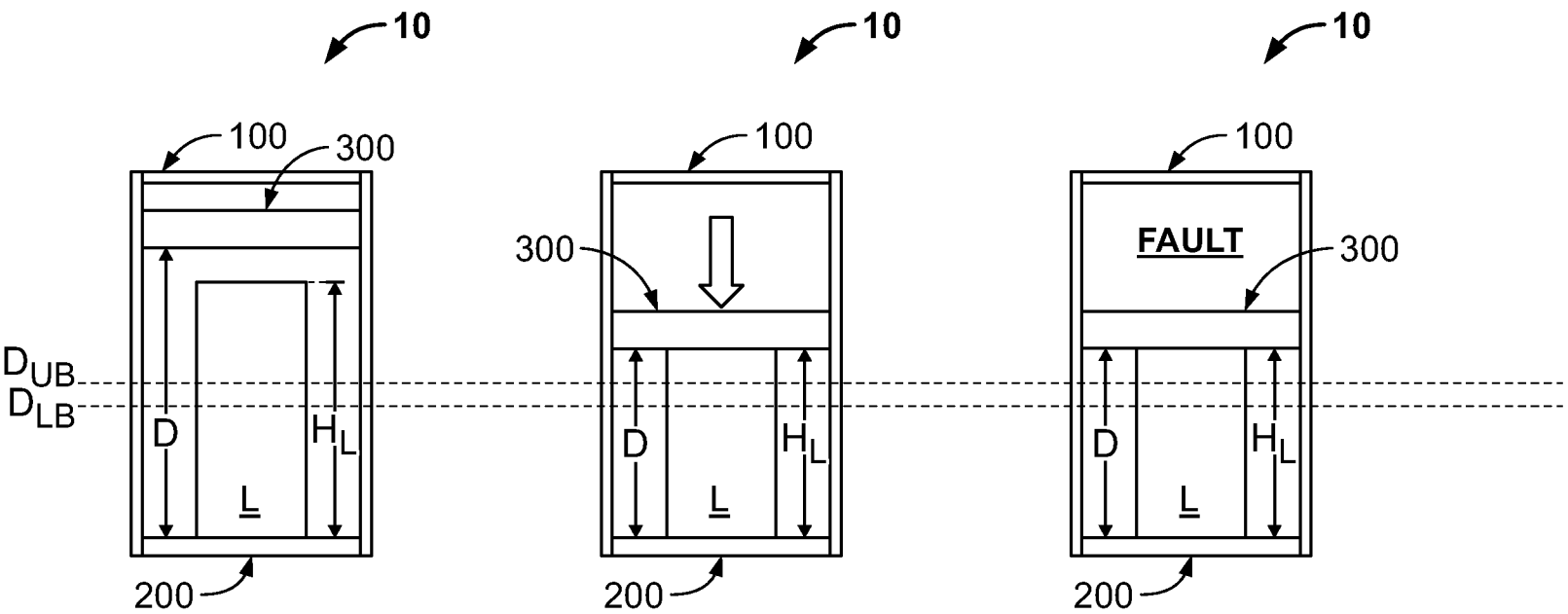
FIGS. 5A-5C are simplified front elevational views of the strapping machine of FIG. 1 during another example of the load verification and strapping process of FIG. 3.

Turning to FIGS. 5A-5C, FIG. 5A illustrates the strapping machine 10 at the beginning of the process with a load L atop the load supporter 200 and beneath the top platen 300. The load L has a height $H_L$, which at this point is less than the distance D between the support surface 210 of the load supporter 200 and the compression plates 310 of the top platen 300 since the compression plates 310 are not contacting the load L. FIG. 5B illustrates the strapping machine after the top platen 300 has moved downward and begun applying a compressive force $F_C$ to the load L. At this point, the controller 800 monitors the applied compressive force $F_C$ and the distance D, which at this point is equal to the height $H_L$ of the load L, as described above. FIG. 5C illustrates the strapping machine 10 after the controller 800 has determined that the applied compressive force $F_C$ has exceeded the upper compressive force bound $F_{UB}$ of the target compressive force range, that the distance D (and height $H_L$ of the load L) has not yet fallen below the upper distance bound $D_{UB}$ of the target distance range, and in response has stopped the downward movement of the top platen 300 and generated a fault indicating that the load L is taller than desired.

Figures 6A, 6B, 6C:
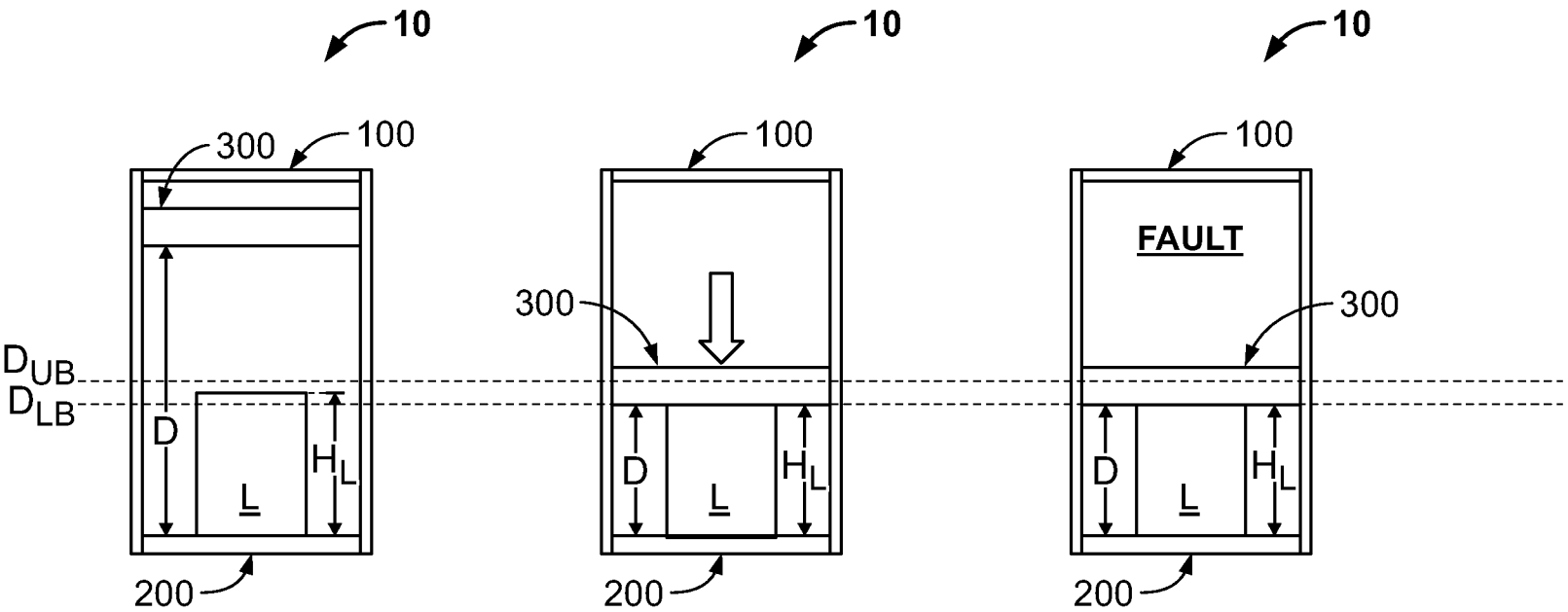
FIGS. 6A-6C are simplified front elevational views of the strapping machine of FIG. 1 during another example of the load verification and strapping process of FIG. 3.

Turning to FIGS. 6A-6C, FIG. 6A illustrates the strapping machine 10 at the beginning of the process with a load L atop the load supporter 200 and beneath the top platen 300. The load L has a height $H_L$, which at this point is already within the target distance range and less than the distance D between the support surface 210 of the load supporter 200 and the compression plates 310 of the top platen 300 since the compression plates 310 are not contacting the load L. FIG. 6B illustrates the strapping machine after the top platen 300 has moved downward and begun applying a compressive force $F_C$ to the load L. At this point, the controller 800 monitors the applied compressive force $F_C$ and the distance D, which at this point is equal to the height $H_L$ of the load L, as described above. FIG. 6C illustrates the strapping machine 10 after the controller 800 has determined that the distance D (and height $H_L$ of the load L) has fallen below the lower distance bound $D_{LB}$ of the target distance range, that the applied compressive force $F_C$ has not yet exceeded the lower compressive force bound $F_{LB}$ of the target compressive force range, that and in response has stopped the downward movement of the top platen 300 and generated a fault indicating that the load L is shorter than desired.

The strapping machine 10 and its load verification and strapping process 1000 solve the problems of prior art strapping machines that result in identical strapped loads having heights that may fall outside of a target height range. Specifically, using load height measurements (i.e., measurements of the distance between the top platen and the load supporter) in addition to compressive force measurements to determine when to strap a load ensures that the strapping machine 10 straps identical loads such that their heights are all within the same target height range. An added benefit is that the strapping machine 10 can identify loads that differ from a desired load because the heights of those loads fall outside of the target height range (as determined by the controller).

In other embodiments, the strapping machine includes a force sensor (such as a load cell or any other suitable sensor) configured to directly measure the compressive force $F_C$ the top platen applies to the load. The force sensor is communicatively connected to the controller so the controller can receive signals from the force sensor. In these embodiments, since the force sensor directly measures the compressive force $F_C$ the controller does not calculate the compressive force $F_C$ based on feedback from the top-platen actuator 350.

In other embodiments, the distance sensor is not configured to directly measure the distance between the support surface and the compression plates. In these embodiments, the distance sensor is configured to measure another distance (such as the distance the top platen has moved), and the controller is configured to determine the distance between the support surface and the compression plates based on the measured other distance. In other words, the controller may be configured to determine the distance between the support surface and the compression plates either directly (based on the distance sensor's direct measurement of that distance) or indirectly (based on the distance sensor's measurement of another distance).

In various embodiments, the strapping machine of the present disclosure comprises a frame; a top platen supported by the frame; a load supporter below the top platen; a top-platen actuator operably connected to the top platen to move the top platen toward and away from the load supporter; a strapping head; and a controller configured to: control the top-platen actuator to move the top platen toward the load supporter and a load positioned on the load supporter; and responsive to determining that both: (1) a distance between the top platen and the load supporter is within a target distance range; and (2) a compressive force the top platen applies to the load is within a target compressive force range, control the strapping head to strap the load.

In certain such embodiments, the strapping machine further comprises a distance sensor, and the controller is further configured to determine the distance based on feedback from the distance sensor.

In certain such embodiments, the distance sensor is configured to determine the distance.

In certain such embodiments, the controller is further configured to, responsive to determining that both: (1) the distance is within the target distance range; and (2) the compressive force is within the target compressive force range, control the top platen actuator to stop moving the top platen toward the load supporter.

In certain such embodiments, the controller is further configured to, responsive to determining that: (1) the compressive force exceeds an upper compressive force bound of the target compression force range while (2) the distance is greater than an upper distance bound of the target distance range, determine that a fault has occurred and control the top platen actuator to stop moving the top platen toward the load supporter.

In certain such embodiments, the controller is further configured to, responsive to determining that: (1) the distance is less than a lower distance bound of the target distance range while (2) the compressive force does not exceed the upper compressive force bound of the target compression force range, determine that a fault has occurred and control the top platen actuator to stop the top platen.

In certain such embodiments, the controller is further configured to, responsive to determining that: (1) the distance is less than a lower distance bound of the target distance range while (2) the compressive force does not exceed an upper compressive force bound of the target compression force range, determine that a fault has occurred and control the top platen actuator to stop the top platen.

In certain such embodiments, the controller is further configured to determine the compressive force.

In certain such embodiments, the controller is further configured to determine the compressive force based on feedback from the top-platen actuator.

In certain such embodiments, the strapping machine further comprises a force sensor configured to determine the compressive force, and the controller is configured to determine the compressive force based on feedback from the force sensor.

In various embodiments, a method of operating a strapping machine of the present disclosure comprises moving a top platen toward a load supporter on which a load is positioned; and responsive to determining that both: (1) a distance between the top platen and the load supporter is within a target distance range; and (2) a compressive force the top platen applies to the load is within a target compressive force range, strapping the load.

In certain such embodiments, the method further comprises determining the distance based on feedback from a distance sensor.

In certain such embodiments, the method further comprises stopping the movement of the top platen toward the load supporter responsive to determining that both: (1) the distance is within the target distance range; and (2) the compressive force is within the target compressive force range In certain such embodiments, the method further comprises, responsive to determining that: (1) the compressive force exceeds an upper compressive force bound of the target compression force range while (2) the distance is greater than an upper distance bound of the target distance range, determining that a fault has occurred and stopping movement of the top platen toward the load.

In certain such embodiments, the method further comprises, responsive to determining that: (1) the distance is less than a lower distance bound of the target distance range while (2) the applied compressive force does not exceed the upper compressive force bound of the target compression force range, determining that a fault has occurred and stopping the top platen.

In certain such embodiments, the method further comprises, responsive to determining that: (1) the distance is less than a lower distance bound of the target distance range while (2) the applied compressive force does not exceed an upper compressive force bound of the target compression force range, determining that a fault has occurred and stopping the top platen.

In certain such embodiments, the method further comprises determining the compressive force.

In certain such embodiments, the method further comprises determining the compressive force based on feedback from a top-platen actuator that controls movement of the top platen.

In certain such embodiments, the method further comprises determining the compressive force based on feedback from a force sensor.

In certain such embodiments, the method further comprises receiving one or more operator inputs representing at least one of the target distance range and the target compressive force range.

The invention claimed is:

1. A strapping machine comprising:

a frame;

a top platen supported by the frame;

a load supporter below the top platen;

a top-platen actuator operably connected to the top platen to move the top platen toward and away from the load supporter;

a strapping head;

a distance sensor; and a controller configured to:

control the top-platen actuator to move the top platen toward the load supporter and a load positioned on the load supporter;

as the top platen moves toward the load supporter and the load, determine and monitor a distance between the top platen and the load supporter based on feedback from the distance sensor; and responsive to determining that both: (1) the distance between the top platen and the load supporter is within a target distance range; and (2) a compressive force the top platen applies to the load is within a target compressive force range, control the strapping head to strap the load.

2. The strapping machine of claim 1, wherein the distance sensor is configured to determine the distance.

3. The strapping machine of claim 1, wherein the controller is further configured to, responsive to determining that both: (1) the distance is within the target distance range; and (2) the compressive force is within the target compressive force range, control the top platen actuator to stop moving the top platen toward the load supporter.

4. The strapping machine of claim 1, wherein the controller is further configured to, responsive to determining that: (1) the compressive force exceeds an upper compressive force bound of the target compression force range while (2) the distance is greater than an upper distance bound of the target distance range, determine that a fault has occurred and control the top platen actuator to stop moving the top platen toward the load supporter.

5. The strapping machine of claim 4, wherein the controller is further configured to, responsive to determining that: (1) the distance is less than a lower distance bound of the target distance range while (2) the compressive force does not exceed the upper compressive force bound of the target compression force range, determine that a fault has occurred and control the top platen actuator to stop the top platen.

6. The strapping machine of claim 1, wherein the controller is further configured to, responsive to determining that: (1) the distance is less than a lower distance bound of the target distance range while (2) the compressive force does not exceed an upper compressive force bound of the target compression force range, determine that a fault has occurred and control the top platen actuator to stop the top platen.

7. The strapping machine of claim 1, wherein the controller is further configured to determine the compressive force.

8. The strapping machine of claim 7, wherein the controller is further configured to determine the compressive force based on feedback from the top-platen actuator.

9. The strapping machine of claim 7, further comprising a force sensor configured to determine the compressive force, wherein the controller is further configured to determine the compressive force based on feedback from the force sensor.

10. The strapping machine of claim 1, wherein the distance sensor comprises one of: a laser sensor and an encoder.

11. A method of operating a strapping machine, the method comprising:

moving a top platen downward toward a load supporter on which a load is positioned;

as the top platen moves downward toward the load supporter and the load, determining a distance between the top platen and the load supporter based on feedback from a distance sensor; and responsive to determining that both: (1) the distance between the top platen and the load supporter is within a target distance range; and (2) a compressive force the top platen applies to the load is within a target compressive force range, strapping the load by a strapping head.

12. The method of claim 11, further comprising stopping the movement of the top platen toward the load supporter responsive to determining that both: (1) the distance is within the target distance range; and (2) the compressive force is within the target compressive force range.

13. The method of claim 11, further comprising, responsive to determining that: (1) the compressive force exceeds an upper compressive force bound of the target compression force range while (2) the distance is greater than an upper distance bound of the target distance range, determining that a fault has occurred and stopping movement of the top platen toward the load.

14. The method of claim 13, further comprising, responsive to determining that: (1) the distance is less than a lower distance bound of the target distance range while (2) the applied compressive force does not exceed the upper compressive force bound of the target compression force range, determining that a fault has occurred and stopping the top platen.

15. The method of claim 11, further comprising, responsive to determining that: (1) the distance is less than a lower distance bound of the target distance range while (2) the applied compressive force does not exceed an upper compressive force bound of the target compression force range, determining that a fault has occurred and stopping the top platen.

16. The method of claim 11, further comprising determining the compressive force.

17. The method of claim 16, further comprising determining the compressive force based on feedback from a top-platen actuator that controls movement of the top platen.

18. The method of claim 16, further comprising determining the compressive force based on feedback from a force sensor.

19. The method of claim 11, further comprising receiving one or more operator inputs representing at least one of the target distance range and the target compressive force range.

* * * * *